US009016082B2

(12) United States Patent
Hancock

(10) Patent No.: US 9,016,082 B2
(45) Date of Patent: Apr. 28, 2015

(54) CONDENSING UNIT DESUPERHEATER

(75) Inventor: Stephen S. Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 710 days.

(21) Appl. No.: 12/794,149

(22) Filed: Jun. 4, 2010

(65) Prior Publication Data

US 2011/0296856 A1 Dec. 8, 2011

(51) Int. Cl.

| | |
|---|---|
| ***F25D 17/06*** | (2006.01) |
| ***F25B 39/04*** | (2006.01) |
| ***F25B 40/04*** | (2006.01) |
| ***F28D 1/04*** | (2006.01) |
| ***F28D 1/047*** | (2006.01) |
| *F28D 21/00* | (2006.01) |

(52) U.S. Cl.
CPC ..... *F25B 39/04* (2013.01); *F25B 40/04* (2013.01); *F28D 1/0417* (2013.01); *F28D 1/0472* (2013.01); *F28D 2021/007* (2013.01)

(58) Field of Classification Search
CPC ..... F25B 39/04; F25B 40/04; F25B 2339/04
USPC ..... 62/89, 507, 513
See application file for complete search history.

(56) References Cited

U.S. PATENT DOCUMENTS

| | | | | |
|---|---|---|---|---|
| 2,044,832 A | | 6/1936 | Child | |
| 2,454,654 A | | 11/1948 | Kaufman | |
| 3,077,226 A | | 2/1963 | Matheny | |
| 3,828,575 A | * | 8/1974 | Malcosky et al. | 62/476 |
| 4,535,838 A | | 8/1985 | Gray et al. | |
| 4,554,968 A | | 11/1985 | Haas | |
| 4,742,864 A | * | 5/1988 | Duell et al. | 165/122 |
| 4,869,314 A | * | 9/1989 | Laing et al. | 165/120 |

(Continued)

FOREIGN PATENT DOCUMENTS

| | | | |
|---|---|---|---|
| EP | 1837608 | A1 | 9/2007 |
| WO | 8800676 | A1 | 1/1988 |
| WO | 2009076623 | A1 | 6/2009 |

OTHER PUBLICATIONS

Canadian Office Action; Application No. 2,741,939; dated Feb. 18, 2013; 4 pages.

(Continued)

*Primary Examiner* — Frantz Jules
*Assistant Examiner* — Brian King
(74) *Attorney, Agent, or Firm* — Conley Rose, P.C.; J. Robert Brown, Jr.; Michael J. Schofield

(57) ABSTRACT

A condensing unit has a fan selectively operable to draw air through the condensing unit along an airflow path, a first row of condenser tubes disposed along the airflow path, and a second row of desuperheater tubes disposed along the airflow path downstream relative to the first row of condenser tubes. A condensing unit has an airflow path, a desuperheater heat exchanger disposed along the airflow path, and a condenser heat exchanger disposed along the airflow path. A method of desuperheating a refrigerant includes causing air having a first air temperature to encounter a condenser tube comprising refrigerant having a first refrigerant temperature, raising the temperature of the air to a second air temperature, and causing the air having the second air temperature to encounter a desuperheater tube comprising refrigerant having a second refrigerant temperature higher than the first refrigerant temperature.

14 Claims, 4 Drawing Sheets

(56) References Cited

U.S. PATENT DOCUMENTS

| | | | | |
|---|---|---|---|---|
| 5,205,138 | A | 4/1993 | Besore et al. | |
| 6,029,463 | A * | 2/2000 | Stenvinkel | 62/115 |
| 6,382,310 | B1 | 5/2002 | Smith | |
| 6,435,269 | B1 * | 8/2002 | Hancock | 165/144 |
| 7,121,328 | B1 | 10/2006 | McDonald et al. | |
| 7,281,389 | B1 * | 10/2007 | O'Brien et al. | 62/272 |
| 7,779,898 | B2 * | 8/2010 | Morrison et al. | 165/150 |
| 2010/0251742 | A1 * | 10/2010 | Tucker et al. | 62/324.6 |

OTHER PUBLICATIONS

Chinese Office Action; Application No. 201110191586.0; dated Jan. 25, 2013; 12 pages.
Chinese Office Action; Application No. 201110191586.0; dated Oct. 11, 2013; 20 pages.
Chinese Notice on Grant of Patent Right for Invention; Application No. 201110191586.0; dated Aug. 25, 2014; 5 pages.
Canadian Office Action; Application No. 2,741,939; dated Dec. 18, 2013; 3 pages.

* cited by examiner

FIG. 4
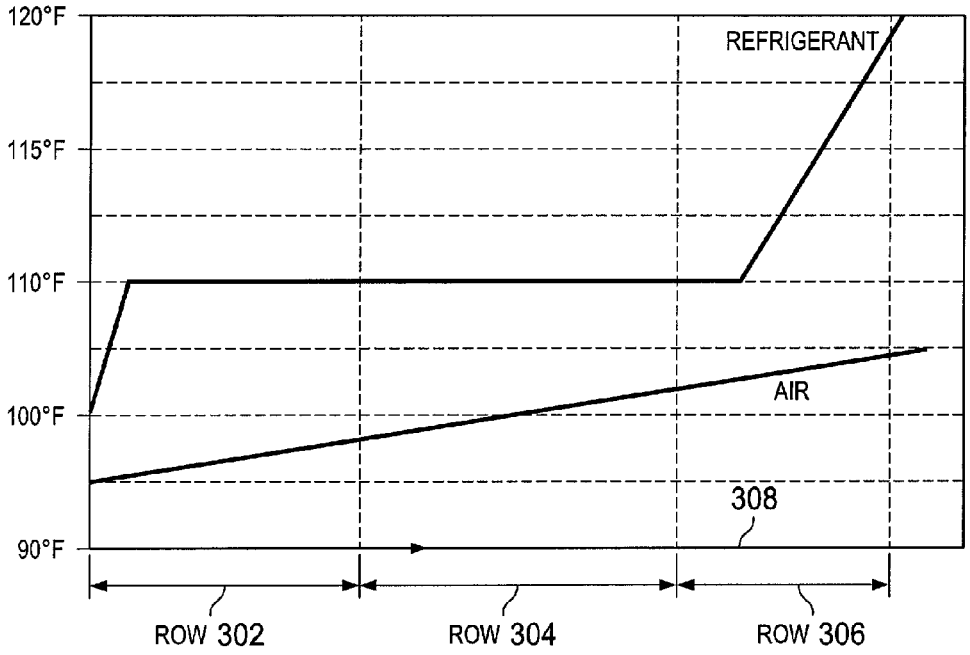
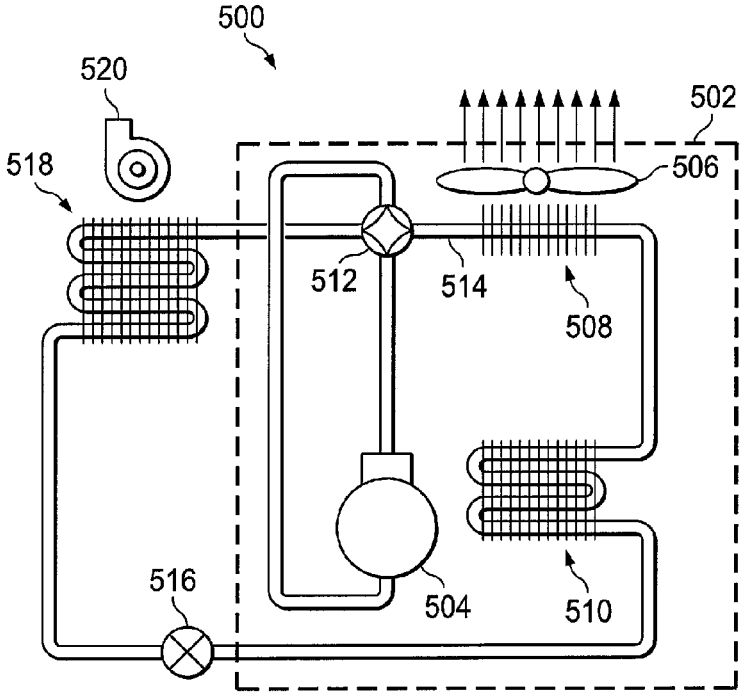
FIG. 5

CONDENSING UNIT DESUPERHEATER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise one or more so-called "condensing units" that may comprise one or more compressors, a so-called condenser coil, and a fan assembly. In operation, a compressor may compress refrigerant and discharge superheated refrigerant (i.e., refrigerant at a temperature greater than a saturation temperature of the refrigerant) to the condenser coil. As the refrigerant passes through the condenser coil, a fan assembly may be configured to selectively force air into contact with the condenser coil. In response to the air contacting the condenser coil, heat may be transferred from the refrigerant to the air, thereby desuperheating the refrigerant and/or otherwise reducing a temperature of the refrigerant. In some cases, the temperature of the refrigerant within the condenser coil is reduced to a saturation temperature of the refrigerant. Continued removal of heat from the refrigerant at the saturation temperature in combination with appropriately maintained pressure within the condenser coil may result in transforming some or all of the gaseous phase refrigerant to liquid phase refrigerant.

Refrigerant may generally exit the condenser coil in a liquid phase and/or a gaseous and liquid mixed phase. The refrigerant may thereafter be delivered from the condenser coil to a refrigerant expansion device where the refrigerant pressure is reduced and after which, the refrigerant is selectively discharged into a so-called evaporator coil of the HVAC system that may provide a cooling function.

SUMMARY OF THE DISCLOSURE

In some embodiments of the disclosure, a condensing unit is provided that has a fan selectively operable to draw air through the condensing unit along an airflow path, a first row of condenser tubes disposed along the airflow path, and a second row of desuperheater tubes disposed along the airflow path downstream relative to the first row of condenser tubes.

In some other embodiments of the disclosure, a condensing unit is provided that has an airflow path, a desuperheater heat exchanger disposed along the airflow path, and a condenser heat exchanger disposed along the airflow path.

In other embodiments of the disclosure, a method of desuperheating a refrigerant is provided. The method comprises causing air having a first air temperature to encounter a condenser tube comprising refrigerant having a first refrigerant temperature, transferring heat from the refrigerant of the condenser tube to the air and raising the temperature of the air to a second air temperature, and causing the air having the second air temperature to encounter a desuperheater tube comprising refrigerant having a second refrigerant temperature higher than the first refrigerant temperature.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

FIG. 4 is a chart showing changes in refrigerant temperature and air temperature relative to movement along a length of an airflow path of the condensing unit of FIG. 3; and FIG. 5 is a simplified schematic of an embodiment of a so-called heat pump HVAC system comprising a condensing unit substantially similar to at least one of the condensing unit of FIG. 2 and the condensing unit of FIG. 3.

DETAILED DESCRIPTION

Figure 1:
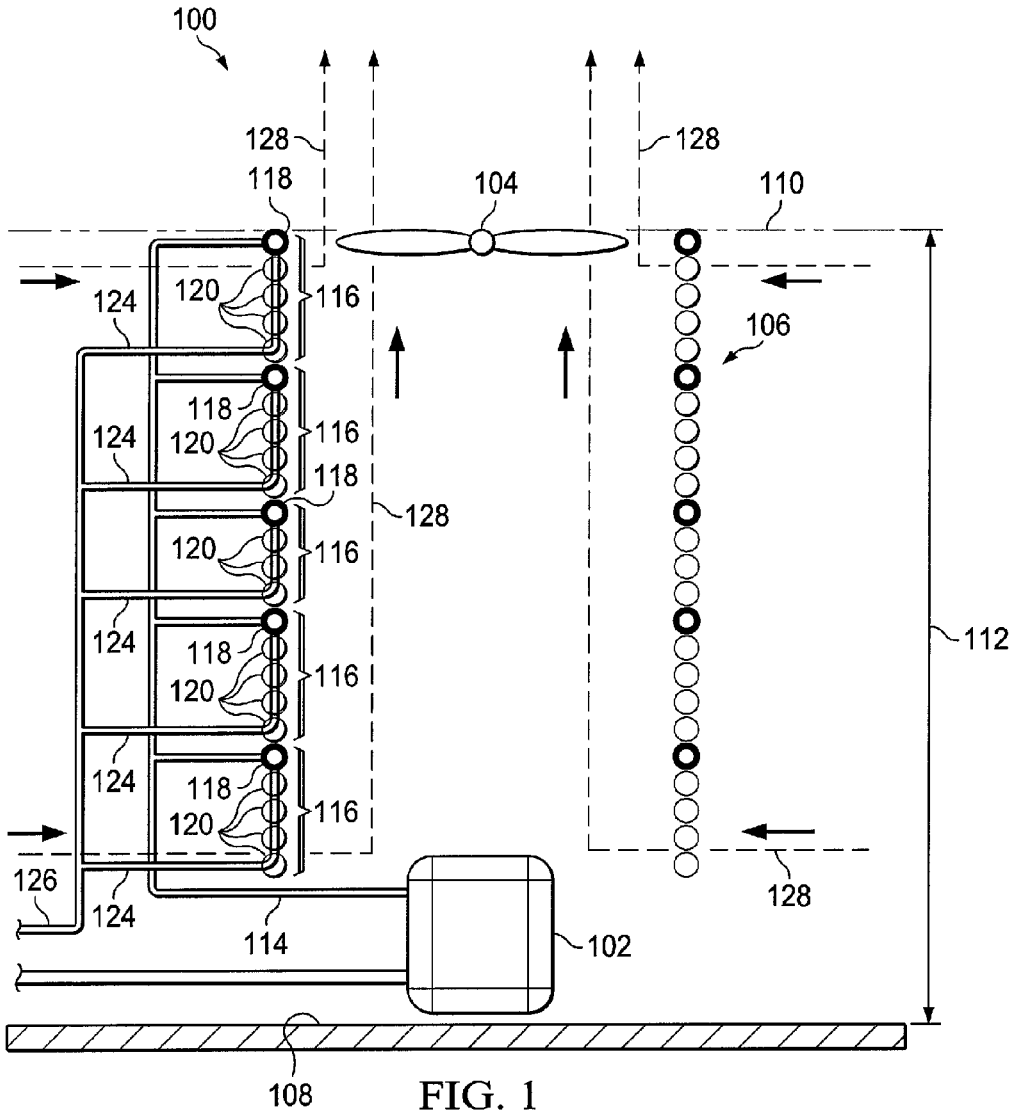
FIG. 1 is a simplified schematic of a condensing unit.

There is a need for HVAC systems with increased efficiency ratings. Some HVAC systems may be afforded efficiency ratings according to the well known Energy Efficiency Ratio (EER) efficiency standard. In some cases, a compressor may be a primary energy consuming component in a condensing unit. Accordingly, efforts have been made to reduce the amount of work a compressor must perform to accomplish a desired rate of heat exchange of the condensing unit. By reducing the amount of work performed by the compressor, less energy is consumed by the condensing unit, and the efficiency of the HVAC system may increase. In some cases, heat exchangers may be chosen that reduce condensing temperatures in an effort to reduce an amount of work necessary to be performed by a compressor. However, lowering the condensing temperature, without making other system changes, may lower a rate of heat transfer (Q) of a condenser coil of an HVAC system condensing unit and, in turn, may lower an EER of the HVAC system.

The rate of heat transfer (Q) of an air-cooled condenser coil may be expressed as $Q=U*A*\Delta T$, where U is an overall heat-transfer coefficient, A is a heat transfer surface area, and $\Delta T$ is a temperature difference between the two operating fluids of the heat exchanger. A first operating fluid of the condenser coil may be air while a second operating fluid of the condenser coil may be a refrigerant. In accordance with the principles of the equation above, as the saturation temperature of a refrigerant is reduced, the temperature difference between the two operating fluids, $\Delta T$, may be reduced resulting in an undesirably lower rate of heat transfer Q if no other system changes are made. Accordingly, to maintain and/or increase EERs of condensing units with relatively lower condensing temperatures, the rate of heat transfer Q may be increased and/or maintained by increasing the heat transfer surface area A to compensate for the lower $\Delta T$. In some embodiments, the heat transfer surface area A may be increased by simply adding more tubing to a condenser coil. In condenser coils that generally vertically stack tubing, the addition of tubing to a condenser coil may increase an overall height of the condenser coil.

In response to increasing the heat transfer surface area A of some condenser coils, an overall housing size of some condensing units may be undesirably increased. In some cases, the larger condensing units may be considered undesirable aesthetically and/or due to the increased space requirement. Despite the increases in efficiency gained by enlarging the heat transfer surface area A of some condensing coils, there is a persistent need for condensing units that provide increased EERs and/or occupy less space. This disclosure provides systems and methods for providing condensing units and/or condenser coils with an increased efficiency and/or for providing condensing units and/or condenser coils that occupy less space while maintaining a desired efficiency and/or rate of heat transfer.

Referring now to FIG. 1, a simplified schematic diagram of a condensing unit 100 is shown. Condensing unit 100 generally comprises a compressor 102, a fan 104, and a combined-type heat exchanger 106. Generally, the condensing unit 100 comprises a bottom side 108 that may generally be located near ground level or another support structure for the condensing unit 100 while a top side 110 may generally be associated with one or more of the upper end of the heat exchanger 106 and/or a vertical location of a portion of the fan 104. In some embodiments, an overall height 112 of the heat exchanger 106 may substantially extend from near the bottom side 108 to the top side 110.

The combined-type heat exchanger 106 of the condensing unit 100 is configured to receive compressed refrigerant from the compressor 102 and to both desuperheat the refrigerant and condense the refrigerant from a vapor to a liquid. In some embodiments, the heat exchanger 106 may be fed discharge refrigerant gas from the compressor 102 through a discharge line 114. In some embodiments, the discharge line 114 may feed a plurality of parallel fluid circuits 116. Each fluid circuit 116 may comprise a desuperheating tube 118 and a plurality of condenser tubes 120. Most generally, refrigerant may flow from the discharge line 114 into each of the desuperheating tubes 118 of the plurality of parallel fluid circuits 116 and then flow from the desuperheating tubes 118 into serially connected downstream condenser tubes 120. The refrigerant may then exit the each of the plurality of parallel fluid circuits 116 through a plurality of circuit exit tubes 124 and collectively feed the refrigerant to a liquid line 126. Liquid and/or mixed phase refrigerant may be delivered to a refrigerant expansion device through the liquid line 126.

The heat exchanger 106 is generally an air-cooled heat exchanger that utilizes ambient environmental air as a first fluid and refrigerant as a second fluid. The compressor 102 may circulate the refrigerant through the heat exchanger 106 in the above-described path while the fan 104 causes flow of the ambient environmental air through the heat exchanger 106. The fan 104 may be generally located near the top side 110. The fan 104 may be configured to draw ambient environmental air from outside the heat exchanger 106, through the heat exchanger 106 in a direction generally perpendicular to the direction of the overall height 112 of the heat exchanger 106, and ultimately up and out of the condensing unit 100. Simplified representations of airflow paths 128 show how air may flow into and out of the condensing unit 100. It will be appreciated that heat transfer rates accomplished by desuperheating tubes 118 may be higher than heat transfer rates accomplished by condenser tubes 120 since the temperature differential between the refrigerant of desuperheating tubes 118 and the ambient environmental air temperature may be higher than the temperature differential between the refrigerant of condenser tubes 120 and the ambient environmental air temperature.

Figure 2:
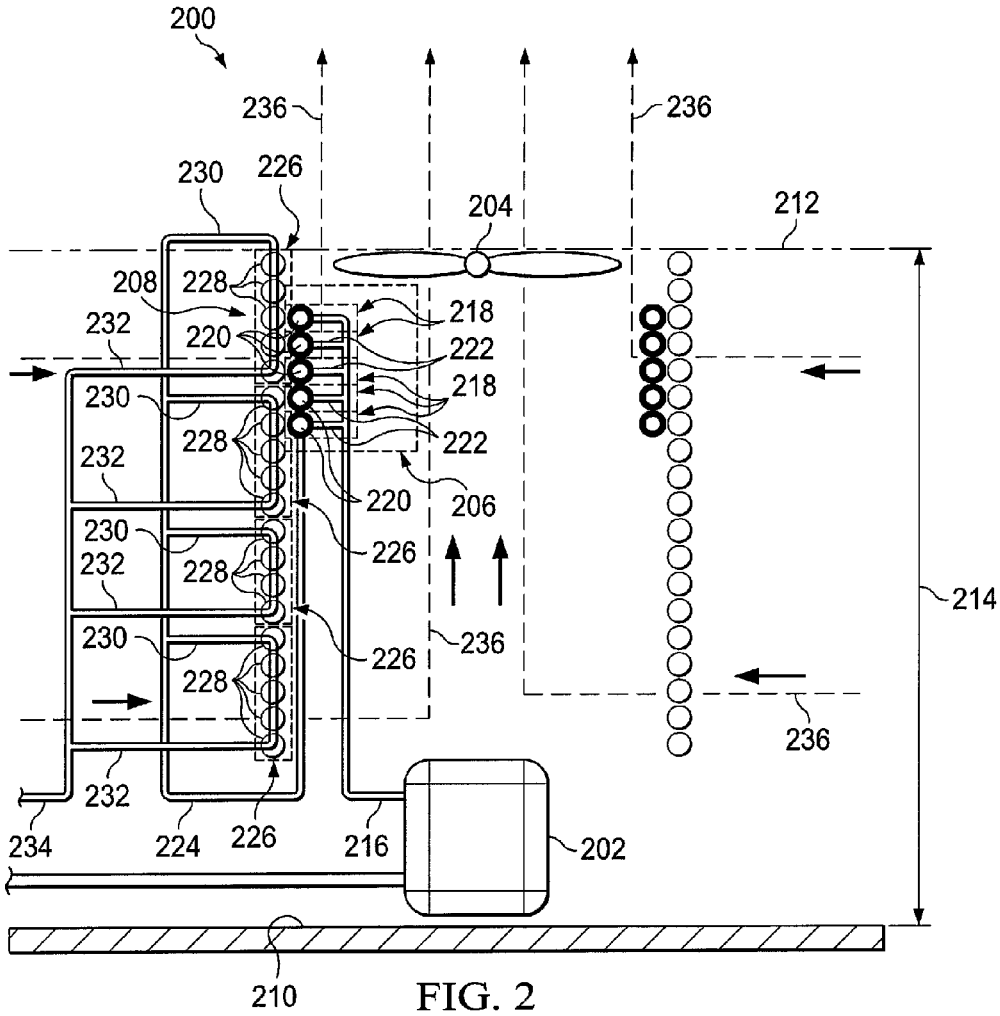
FIG. 2 is a simplified schematic of an alternative embodiment of a condensing unit.

Referring now to FIG. 2, a simplified schematic diagram of an alternative embodiment of a condensing unit 200 is shown. Condensing unit 200 generally comprises a compressor 202, a fan 204, a desuperheater heat exchanger 206, and a condenser heat exchanger 208. Generally, the condensing unit 200 comprises a bottom side 210 that may generally be located near ground level or another support structure for the condensing unit 200 while a top side 212 may generally be associated with one or more of the upper end of one or more of the desuperheater heat exchanger 206 and the condenser heat exchanger 208 and/or a vertical location of a portion of the fan 204. In some embodiments, an overall height 214 of the condenser heat exchanger 208 may substantially extend from near the bottom side 210 to the top side 212.

The desuperheater heat exchanger 206 and the condenser heat exchanger 208 work separately to desuperheat refrigerant and to condense refrigerant, respectively. In some embodiments, the desuperheater heat exchanger 206 may be fed discharge refrigerant gas from the compressor 202 through a discharge line 216. In some embodiments, the discharge line 216 may feed a plurality of parallel desuperheater fluid circuits 218. Each desuperheater fluid circuit 218 may comprise a desuperheater tube 220. Most generally, refrigerant may flow from the discharge line 216 into desuperheater tubes 220 through desuperheater feeder tubes 222 and from desuperheater tubes 220 into a commonly shared desuperheater exit tube 224. The refrigerant may exit the desuperheater heat exchanger 206 through desuperheater exit tube 224.

The refrigerant may be fed from the desuperheater exit tube 224 into a plurality of parallel condenser fluid circuits 226. Each condenser fluid circuit 226 may comprise one or more condenser tubes 228. Most generally, refrigerant may flow from the desuperheater exit tube 224 into condenser tubes 228 through condenser feeder tubes 230. The refrigerant may exit the plurality of parallel condenser fluid circuits 226 through condenser circuit exit tubes 232 and collectively feed the refrigerant to a liquid line 234. Liquid and/or mixed phase refrigerant may be delivered to a refrigerant expansion device through the liquid line 234.

The desuperheater heat exchanger 206 and the condenser heat exchanger 208 are generally air-cooled heat exchangers that utilize ambient environmental air as a first fluid and refrigerant as a second fluid. The compressor 202 may circulate the refrigerant through the heat exchangers 206, 208 in the above-described path while the fan 204 causes flow of the ambient environmental air through the heat exchanger 206, 208. The fan 204 may be generally located near the top side 212. In some embodiments, the desuperheater tubes 220 may be located in a generally downstream airflow location relative to adjacent condenser tubes 228. In some embodiments, the desuperheater heat exchanger 206 may be substantially located within a space substantially enveloped by at least a portion of the condenser heat exchanger 208. In some embodiments, at least a portion of the desuperheater heat exchanger 206 may be located substantially adjacent the fan 204, in a zone of relatively higher air velocity, and/or in a location otherwise selected to ensure airflow through the desuperheater heat exchanger 206 in spite of any air pressure drop attributable to the adjacent placement of the desuperheater heat exchanger 206 relative to the condenser heat exchanger 208.

The fan 204 may be configured to draw ambient environmental air from outside the condenser heat exchanger 208 and through the condenser heat exchanger 208 in a direction generally perpendicular to the direction of the overall height 214 of the condenser heat exchanger 208. The air may thereafter be further drawn from the condenser heat exchanger 208 and through the desuperheater heat exchanger 206 and ultimately up and out of the condensing unit 200. Simplified airflow paths 236 show how air may flow into and out of the condensing unit 200. It will be appreciated that an overall heat transfer rate of the condensing unit 200 is positively affected by ensuring that ambient air encounters at least a portion of the relatively cooler condenser tubes 228 prior to encountering the relatively hotter desuperheater tubes 220. In other words, by providing airflow in the above-described manner, temperature differentials between the ambient environmental air and the heat exchangers 206, 208 may be maximized.

Further, in some embodiments where the condensing unit 100 comprises substantially the same EER efficiency rating as the condensing unit 200, the overall height 214 may be reduced substantially as compared to the overall height 112. Accordingly, in some embodiments, selection of the configuration of condensing unit 200 may provide an overall space requirement reduction as compared to a similarly performing condensing unit 100. Still further, in some embodiments, adoption of the condensing unit 200 configuration as opposed to the condensing unit 100 configuration may provide a substantial increase in efficiency even when both units 100, 200 comprise substantially the same heat exchanger face area.

Figure 3:
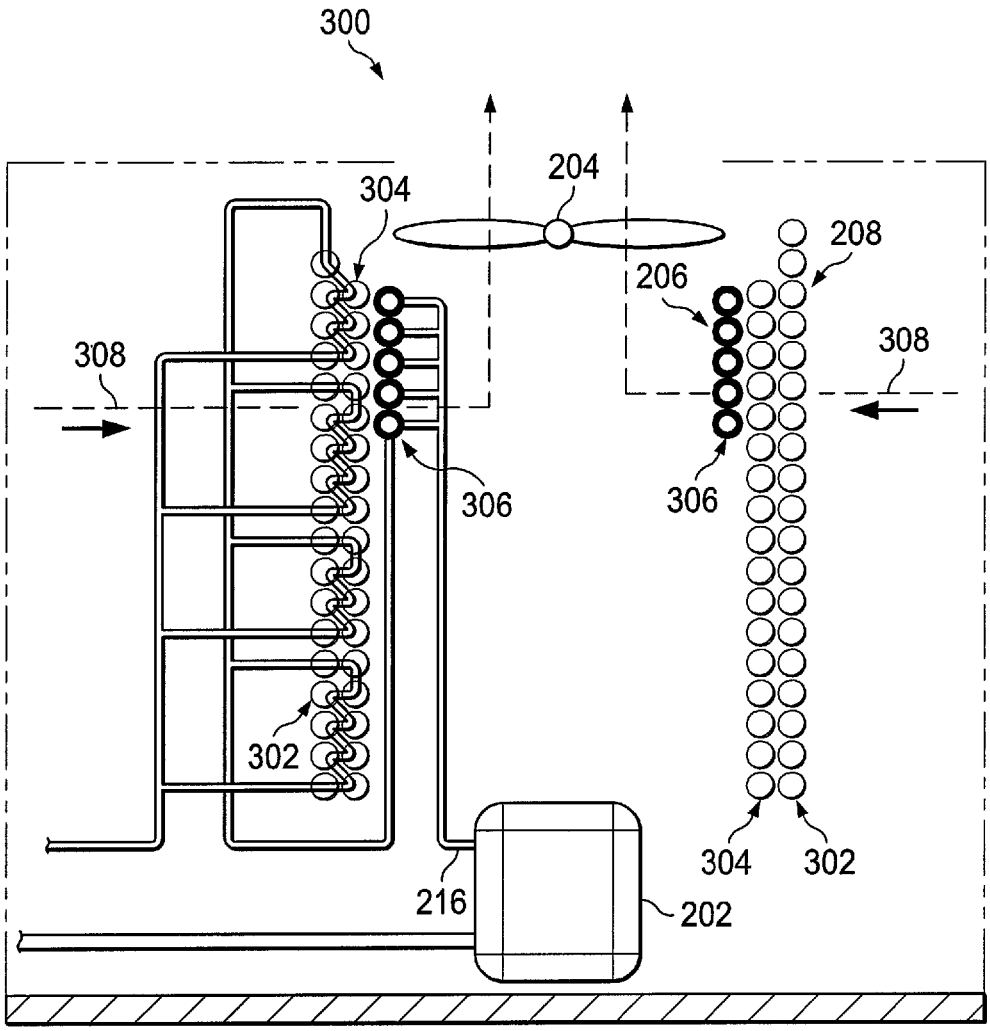
FIG. 3 is a simplified schematic of still another alternative embodiment of a condensing unit.

Referring now to FIG. 3, a simplified schematic diagram of still another alternative embodiment of a condensing unit 300 is shown. Condensing unit 300 is substantially similar to condensing unit 200, except that condensing unit 300 comprises two rows of condenser tubes 228 rather than one row of condenser tubes 228. Accordingly, condensing unit 300 may be described as comprising three rows of tubes: an exterior row of condenser tubes 302, an interior row of condenser tubes 304, and a row of desuperheater tubes 306. While the rows 302, 304, 306 may appear to be columns of tubes, the term "row" is used to emphasize their location relative to the order and direction in which the ambient environmental air that follows simplified airflow paths 308 encounters the rows 302, 304, 306. As such, air following airflow paths 308 first encounters exterior row of condenser tubes 302 (which may be configured to comprise refrigerant relatively cooler than refrigerant of the interior row of condenser tubes 304). Next, the now hotter air encounters the interior row of condenser tubes 304. Finally, the now even hotter air encounters the row of desuperheater tubes 306, which carries the very hot superheated refrigerant.

Referring now to FIG. 4, a chart shows how the refrigerant temperature in each of the three rows 302, 304, 306 may affect air temperature as the air flows along the airflow paths 308. As the air encounters the rows 302 and 304, the refrigerant within the condenser tube rows 302 and 304 is substantially consistently at a saturation temperature 110° F. Accordingly, the implication of the chart is that the heat exchange between the air and the refrigerant at the rows 302 and 304 contribute to condensing the refrigerant from gas phase to liquid phase. Of course, the air temperature increases at rows 302 and 304 due to the above-described heat transfer interaction. Nonetheless, as the heated air encounters the desuperheater row 306, the temperature differential between the refrigerant and the air is greater, thereby increasing the rate of heat transfer despite the general increase in air temperature. The above-described configuration ensures that as the air temperature increases, the air is exposed to hotter refrigerant so that the so-called approach temperature of the heat exchangers 206, 208 is selected to provide increased rates of heat transfer.

Referring now to FIG. 5, a simplified schematic diagram of a heat pump HVAC system 500 comprising a condensing unit 502 substantially similar to at least one of condensing unit 200 and condensing unit 300 is shown. Condensing unit 502 may generally comprise a compressor 504, a fan 506, a desuperheater heat exchanger 508, and a condenser heat exchanger 510. The condensing unit 502 may further comprises a so-called reversing valve 512 that is selectively operable to route refrigerant pumped by the compressor 504 along an alternative route to provide a heating function rather than a cooling function. A difference between the condensing unit 502 and the condensing units 200, 300 is that the desuperheater heat exchanger 508 may be disposed along a vapor line 514 between the reversing valve 512 and the condenser heat exchanger 510.

FIG. 5 further shows that the heat pump HVAC system 500 comprises an expansion valve 516, an indoor coil 518, and an indoor blower 520, and/or their commonly known equivalents. In this configuration, the desuperheater heat exchanger 508 may perform in a cooling mode substantially the same as the desuperheater heat exchanger 206. However, while the reversing valve 512 is configured to cause the heat pump HVAC system 500 to operate in a heating mode, the desuperheater heat exchanger 508 may provide a greatly reduced impact on heat exchange. Such a reduced impact on heat exchange may be due to the desuperheater heat exchanger 508 and the condenser heat exchanger 510 collectively providing the functionality of an evaporator coil (or indoor coil) and/or because the refrigerant flowing through the desuperheater heat exchanger 508 and the condenser heat exchanger 510 may be very close to the temperature of the ambient environmental air, resulting in a relatively smaller $\Delta T$.

The principles, methods, and condensing unit configurations disclosed herein may be successfully applied to plate-fin type heat exchangers, spine-fin coil type heat exchangers, and or any other type of air-cooled heat exchanger of a condensing unit. Further, it will be appreciated that the systems and methods disclosed herein may be successfully applied to condensing units regardless of the types of refrigerants, fans, compressors, and/or types of feed and/or exit tube assemblies used. In some embodiments, advantages of the above-described systems and methods may be obtained by simply ensuring that airflow through a condensing unit encounters a lower temperature condenser tube prior to encountering a relatively higher temperature desuperheater tube.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: $R=RI+k*(Ru-RI)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A condensing unit, comprising:

a fan selectively operable to draw air through the condensing unit along an airflow path that exits the condensing unit through an air outlet;

a first row of condenser tubes comprising a plurality of parallel condenser fluid circuits disposed along the airflow path, the plurality of parallel condenser fluid circuits comprising (1) an uppermost condenser tube having an uppermost portion, the uppermost portion of the uppermost condenser tube being located closest to an air outlet as compared to other condenser tubes of the first row of condenser tubes and (2) a lowermost condenser tube having a lowermost portion, the lowermost portion of the lowermost condenser tube being located furthest from the air outlet as compared to the other condenser tubes of the first row of condenser tubes; and a second row of desuperheater tubes comprising a plurality of parallel desuperheater fluid circuits and disposed along the airflow path downstream relative to the first row of condenser tubes;

wherein the desuperheater tubes are located between the uppermost portion of the uppermost condenser tube and the lowermost portion of the lowermost condenser tube;

wherein the air flowpath passes over the desuperheater tubes after having passed between the uppermost position of the uppermost portion of the uppermost condenser tube and the lowermost portion of the lowermost condenser tube; and wherein the plurality of the parallel desuperheater fluid circuits are configured to feed refrigerant to the plurality of parallel condenser fluid circuits through a commonly shared desuperheater exit tube.

2. The condensing unit of claim 1, wherein at least a portion of the first row of condenser tubes comprises refrigerant disposed therein having a temperature substantially equal to a saturation temperature of the refrigerant.

3. The condensing unit of claim 1, wherein at least a portion of the second row of desuperheater tubes comprises superheated refrigerant disposed therein.

4. A condensing unit, comprising:

an airflow path that extends from an air inlet to an air outlet;

a desuperheater heat exchanger comprising a plurality of parallel desuperheater fluid circuits and disposed along the airflow path; and a condenser heat exchanger comprising a plurality of parallel condenser fluid circuits disposed along the airflow path, the condenser heat exchanger comprising an uppermost end and a lowermost end, wherein the uppermost end of the condenser heat exchanger is located closest to the air outlet, and wherein the lowermost end of the condenser heat exchanger is located furthest from the air outlet;

wherein at least a portion of the desuperheater heat exchanger is at least partially enveloped by the condenser heat exchanger, wherein the desuperheater heat exchanger is located between the uppermost end of the condenser heat exchanger and the lowermost end of the condenser heat exchanger, wherein the air flowpath passes over the desuperheater tubes after having passed between the uppermost position of the uppermost portion of the uppermost condenser tube and the lowermost portion of the lowermost condenser tube; and wherein the plurality of parallel desuperheater fluid circuits are configured to feed refrigerant to the plurality of parallel condenser fluid circuits through a commonly shared desuperheater exit tube.

5. The condensing unit of claim 4, further comprising:

a compressor;

wherein refrigerant discharged from the compressor passes completely through the desuperheater heat exchanger prior to entering the condenser heat exchanger.

6. The condensing unit of claim 5, wherein the refrigerant received by the desuperheater heat exchanger is superheated.

7. The condensing unit of claim 6, wherein the refrigerant is substantially desuperheated prior to exiting the desuperheater heat exchanger.

8. The condensing unit of claim 4, wherein at least a portion of the desuperheater heat exchanger is disposed downstream along the airflow path relative to the condenser heat exchanger.

9. The condensing unit of claim 8, wherein at least a portion of refrigerant within the condenser heat exchanger is substantially at a saturation temperature of the refrigerant.

10. The condensing unit of claim 9, wherein at least a portion of the desuperheater heat exchanger is located in proximity to a fan of the condensing unit.

11. The condensing unit of claim 10, wherein at least one of the desuperheater heat exchanger and the condenser heat exchanger comprises a plurality of rows of tubes along the airflow path.

12. The condensing unit of claim 11, wherein the airflow path is configured to direct air into the condensing unit in a first direction and wherein the airflow path is configured to direct air out of the condensing unit in a second direction that is substantially orthogonal to the first direction.

13. A method of desuperheating a refrigerant, comprising:

causing air having a first air temperature to encounter a condenser tube of a plurality of parallel condenser fluid circuits comprising refrigerant having a first refrigerant temperature;

transferring heat from the refrigerant of the condenser tube to the air and raising the temperature of the air to a second air temperature; and causing the air having the second air temperature to encounter a desuperheater tube of a plurality of parallel desuperheater fluid circuits comprising refrigerant having a second refrigerant temperature higher than the first refrigerant temperature;

wherein the plurality of parallel condenser fluid circuits comprises (1) an uppermost condenser fluid circuit having an uppermost condenser tube having an uppermost portion, the uppermost portion of the uppermost condenser tube being located closest to an air outlet as compared to other condenser tubes of the plurality of parallel condenser fluid circuits and (2) a lowermost condenser fluid circuit having a lowermost condenser tube having a lowermost portion, the lowermost portion of the lowermost condenser tube being located furthest from the air outlet as compared to other condenser tubes of the plurality of parallel condenser fluid circuits;

wherein the desuperheater fluid circuits are located between the uppermost portion of the uppermost condenser tube of the uppermost condenser fluid circuit and the lowermost portion of the lowermost condenser tube of the lowermost condenser fluid circuit;

wherein the air having the second air temperature encounters the desuperheater tube is passed between the uppermost portion of the uppermost condenser tube and the lowermost portion of the lowermost condenser tube prior to encountering the desuperheater tube; and wherein the plurality of parallel desuperheater fluid circuits are configured to feed refrigerant to the plurality of parallel condenser fluid circuits through a commonly shared desuperheater exit tube.

14. The method of claim 13, wherein the first refrigerant temperature is a saturation temperature of the refrigerant.

* * * * *